United States Patent [19]

Allen

[11] Patent Number: 4,507,889

[45] Date of Patent: Apr. 2, 1985

[54] SPEED LOADER

[76] Inventor: Dillis V. Allen, 240 Lincolnshire Ct., Schaumburg, Ill. 60193

[21] Appl. No.: 456,360

[22] Filed: Jan. 7, 1983

Related U.S. Application Data

[63] Continuation-in-part of Ser. No. 262,224, May 11, 1981, abandoned.

[51] Int. Cl.[3] ..... F42B 39/04

[52] U.S. Cl. ..... 42/89

[58] Field of Search ..... 42/89, 88, 87

[56] References Cited

U.S. PATENT DOCUMENTS

| | | | |
|---|---|---|---|
| 1,971,526 | 8/1934 | Kempf | 42/89 |
| 2,215,726 | 9/1940 | Masterton-Smith | 42/89 |
| 2,637,930 | 5/1953 | Mason | 42/89 |
| 2,896,353 | 7/1959 | Hunt | 42/89 |
| 3,213,559 | 10/1965 | Matich | 42/89 |
| 3,225,482 | 12/1965 | Olson | 42/89 |

*Primary Examiner*—Charles T. Jordan

[57] ABSTRACT

A loader for simultaneously loading all of the cartridges into the annularly arranged chambers of a swing-out cylinder of a revolver. The loader is a one-piece flexible polyurethane or silicone rubber molding having a generally circular portion with an annular array of apertures that permit the insertion of the cartridges from one side of the apertures. Each aperture has an annular guide portion of sufficient length to hold the cartridges parallel and a frusto-conical rim-engaging portion that facilitates easy release of the rim from the loader. After the cartridges are inserted into the loader, the user holds the loader, guides the cartridges into the cylinder chambers, and then lifts up on an integral tab and rolls the flexible loader over the rims of the cartridges, releasing the cartridges into the chambers.

The resiliency of the loader protects the cartridges if the filled loader is dropped and its shape prevents it from rolling away.

17 Claims, 19 Drawing Figures

SPEED LOADER

RELATED APPLICATIONS

This application is a continuation-in-part of my application Ser. No. 262,224 filed May 11, 1981, now abandoned.

BACKGROUND OF THE INVENTION

Pistol shooting has become increasingly popular during the last two decades, not only because of a general increase in recreational activities during that period, but also due to an increased awareness in communities as well as the nation as a whole of the necessity to increase personal and property security. As a result of this increased awareness and a desire for a disciplined recreational activity, organized pistol competition teams and events have been organized throughout the nation.

Law enforcement officials and military personnel also participate in pistol target shooting and have teams that compete on a continuous basis.

This increased competition and popularity in pistol target shooting as well as the desire for achieving proficiency in the handling of pistols for personal security has created a need for devices that facilitate loading cartridges into revolvers. During competition shooting on the range as well as in attempting to arm a weapon for other uses, the normal manual loading of ammunition cartridges in the cylinder of the revolver has been found unsatisfactory. In manual loading the cartridges, usually six, are held in one hand and the piston in the other, and the shooter feeds cartridges from the palm of his hand to his index finger and thumb of the same hand and inserts them into the pistol chamber. Frequently even the most dextrous competitor or shooter, not to speak of the average shooter, will fumble or drop cartridges during this cumbersome one-at-a-time loading process. Further, it is both distracting and time-consuming to load the revolver one cartridge at a time.

To alleviate the problems of manual one-at-a-time revolver loading, several speed loading devices have been developed and marketed during the past ten or fifteen years.

One speed loading device that has achieved considerable commercial success is manufactured by H.K.S. Products. This loader has a rigid cup-shaped receptacle having an annular array of closed-end bores that receive the rear ends of the cartridges which are dropped in by the shooter one at a time, rim-end first. An aluminum spindle is rotatably mounted centrally in the receptacle and carries a star-like wheel. After the cartridges are dropped in the receptacle, the aluminum spindle is manually rotated by the shooter clamping the star wheel over the rims holding the cartridges in position. The loader, when ready for use in the range booth, or anywhere, is held in one hand by the user with the pistol in the other with the thumb of the latter hand holding the pistol cylinder from rotation in a swing-out position. The cartridges are then inserted in the chambers and the spindle is manually rotated pivoting the star wheel out of engagement with the rims releasing the cartridges into the chambers.

The H.K.S. loader is described in part in U.S. Pat. No. 3,722,125 and reference should be made to that Patent for a more complete description of that loader.

A difficulty in manufacturing the H.K.S. loader results from the requirement of nine different parts in the loader all but two of which need to be machined or worked prior to assembly. The cup-shaped receptacle is a rigid molded plastic piece that is subject to cracking and breakage when the shooter drops the loader, as frequently occurs, particularly if the loader is filled with cartridges. Also the locking spindle must be rotated each time the cartridges are put in the loader and each time the cartridges are released from the loader into the cylinders. While this is not an undue inconvenience for the regular shooter it can present some difficulty for the occasional shooter.

Furthermore, the H.K.S. receptacle interferes with some manufacturers' weapons and requires either a modification of the handle or the purchase of a new set of handle grips designed to accommodate the speed loader, which of course is costly.

Another loader manufactured by Safariland Corporation has found considerable success in the shooter's marketplace. This loader is somewhat similar to the H.K.S. loader described above except that the rotatable spindle is automatically released from the cartridge rims as the cartridges are inserted in the cylinder. This additional feature requires an additional axially movable spindle part, a biasing spring and a rotating inducing spindle cam. It is somewhat difficult to load because the ends of the bullets must be engaged with a flat surface just before the rim engaging spindle is rotated. And, the Safariland loader creates pistol grip interference and requires specially designed models to accommodate various manufacturers' pistols even in the same caliber.

A third prior speed loader is referred to as a "speed strip" manufactured by the Bianchi Company. This speed loader is a straight elongated vinyl plastic molding having six rim receiving T-shaped recesses in one side that receive the rim end of the cartridges. After the shooter loads the rims in the strip, the cartridges are loaded into the cylinders one or two at a time and released by snapping the strip off the rim of the loaded cartridges.

It is the primary object of the present invention to ameliorate the problems noted above in prior art speed loading devices for revolvers.

SUMMARY OF THE PRESENT INVENTION

According to the present invention a one-piece resilient elastomeric speed loader for revolvers is provided that is less costly, simpler to manufacture, faster to load and unload and far less susceptible to damage than any of the prior art speed loading devices known.

Toward these ends, the loader is preferably constructed of a one-piece polyurethane or silicone rubber molding have a hardness ideally about 55 to 70 durometer although hardness durometers in the range of 50 to 75 will operate acceptably. Due to the configuration of this loader it will not interfere with any of the pistol grips of the popular pistols. The configuration of the loader varies slightly from one weapon to another having different calibers or different chamber spacing, but the same speed loader can be used in any weapon made by different manufacturers of the same caliber and chamber spacing.

The embodiments of the invention disclosed in this application are designed for .38 special or .357 caliber pistol having six chambers with centerline to centerline hole spacing for diametrically opposed holes in the center of the cylinder of 0.970 inches, such as the Colt Official Police Special weapon or the more recent Colt Python pistol.

According to one embodiment of the invention, the loader has a circular central portion with an integral handling and release tab that extends radially therefrom and is generally planar in configuration having flat front and rear sides. The central portion has apertures corresponding in number and location to the chambers in the revolver cylinder, e.g., six annularly arrayed apertures. The loader for the .38 special and .357 cartridges is 0.290 inches thick. Each of the apertures has a cylindrical guide portion extending from the rear surface of the central section of 0.187 inches in length and slightly less in diameter than the shell of the cartridge, i.e., a few thousands less than 0.375 inches (.38 special and .357 caliber cartridge diameter). This cylindrical guide portion maintains the cartridges perpendicular to the plane of the loader body and more importantly parallel to one another. The aperture has a quick release frusto-conical end adjacent the guide portion and positioned at the rear surface of the body, against which the cartridge rim seats when in proper position in the loader. This frusto-conical portion has an outer diameter of 0.480 inches, slightly greater than the diameter of the rim (0.435 inches), an inner diameter equal to the guide portion, an axial length of about 0.048 inches, and an angle of 45 degrees with respect to the axis of the aperture. The apertures although symetrical to one another and the central section are positioned asymetrically with respect to a radial line extending from the central portion centrally through the load and release tab.

In use the shooter loads the cartridges one or more at a time bullet-end first through the rear of the loader body into the apertures pressing on the primer ends until the rims are fully seated in the frusto-conical quick-release portion. The pistol with the cylinder swung out is then held in one hand (either left or right depending upon shooter preference) and the loader held in the other hand is lowered over the cylinder inserting the cartridges into the chambers. As the user does this he places the thumb of the same hand holding the loader over the rear surface of the loader engaging it with one or more of the cartridge primer ends, and with the index finger of the same hand positioned beneath the holding and lifting tab he lifts and rolls the flexible body over the tops of the rims releasing the cartridges into the chambers. The asymetric position of the apertures with respect to the holding and lifting tab assures that no two rims will be released exactly simultaneously thereby making the release operation somewhat easier. The frusto-conical quick release rim engaging surfaces make the roll release very easy without detracting from the guiding and aligning function of the annular guide portion apertures.

Because no part of the loader extends rearwardly from the cartridge rims when in proper position in the loader, the present loader does not interfere with the pistol grip in any way and in fact will not damage or scratch any part of the weapon. The shooter may if he desires drop the loader, after release of the cartridges, on the floor or ground for later retrieval without fear of damaging the loader in any way.

According to one feature of the first embodiment of the present invention the loader is color-coded so that the shooter can easily recognize which is designed for a particular weapon without requiring him or her to read model numbers on the loader itself.

DETAILED DESCRIPTION OF THE PREFERRED EMBODIMENTS

Figure 1:
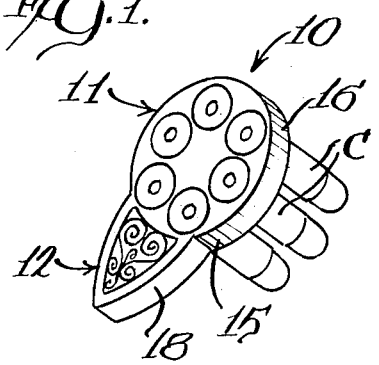
FIG. 1 is a perspective view of one embodiment of the present speed loader with all cartridges in position.

Referring to the drawings and particularly FIGS. 1 to 6, a speed loader 10 is illustrated for simultaneously loading all six cartridges into a revolver, such as a Colt Official Police .38 Model. It should be understood, however, that the principles of the invention are applicable to loaders for other caliber revolvers with certain modifications such as aperture spacing, aperture diameter and loader thickness to accommodate longer and heavier cartridges.

The speed loader tab is a one-piece flexible elastomeric molding and may be constructed of a variety of elastomeric materials such as rubber or silicone rubber and polyurethane. Polyurethane is the product of reaction of a polyhydric alcohol with a diisocyanate. Both polyester and polyether resins may be combined with a suitable diisocyanate to produce the desired polyurethane. Polyurethane reactants that have been found suitable are a polyester "Vibrathane" No. 6007 manufactured by General Chemical Division of Uniroyal, Inc. and a diisocyanate "Isonol" "93" manufactured by Upjohn Company. Silicone rubber has the advantage over polyurethane of lower temperature sensitivity and shorter mold cycle time.

To achieve the proper balance between cartridge guiding and maintaining ease of cartridge release, the loader 10 should have a durometer hardness between 40 to 70, although a hardness in the range of 55 to 62 durometer yields superior results.

The elastomeric speed loader body 10 has a main circular portion 11 and an integral radially extending holding and release projection 12. The body 11 and handle 12 together are planar, having a flat rear wall 13 (FIG. 2) and a flat front wall 14 (FIG. 3), connected by a peripheral wall 15 perpendicular to the front and the back walls that has a semi-annular portion 16 and arcuate segments 18 and 19 forming the sides of the holding and release projection 12.

Figure 2:
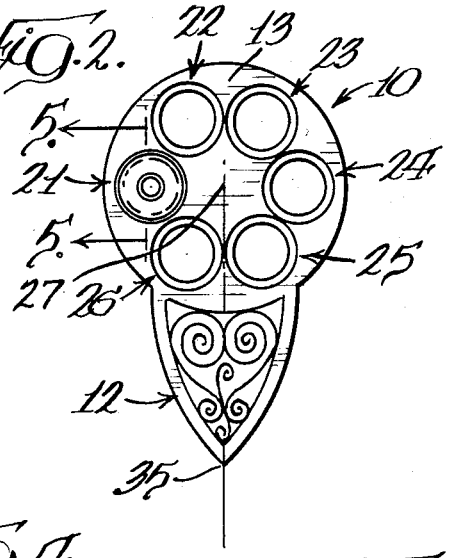
FIG. 2 is a rear plan view of the speed loader illustrated with one cartridge inserted therein.
Figure 3:
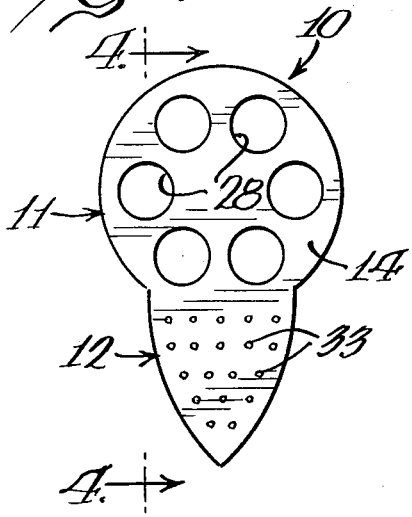
FIG. 3 is a front plan view of the speed loader illustrated in FIG. 1.

As seen in FIGS. 2 and 3 there is an annular array of identical apertures 21, 22, 23, 24, 25 and 26 formed on a circle about center 27. The centers of the apertures 21 through 26 are coincident with the centerline of the cylinder chambers in the revolver for which the loader is designed. Center 27 is also the center for the circle defined by the semi-annular side wall portion 16 of the body portion 11.

Since all of the apertures 21 to 26 are identical, a detailed description of aperture 21 will follow with the understanding that this discussion applies to all of the apertures. Viewing FIGS. 5 and 6, aperture 21 is seen to include a lower cylindrical guide portion 28. The guide portion 28 has a diameter slightly less than the cartridge selected so that the cartridge may be slid easily and smoothly into its seated position shown on FIGS. 5 and 6, and is of sufficient length so that the cartridge will remain perpendicular to the central portion 11 of the body and parallel to the other cartridges. For the .38 special loader illustrated, the diameter of guide portion 28 is 0.372 inches compared to a cartridge shell diameter of 0.374 inches, and the axial length of the guide portion is 0.227 inches. The entire thickness of the body 10 or height of sidewall 16 is 0.275 inches, although body thickness in the range of about 0.240 to 0.300 will operate.

Figure 5:
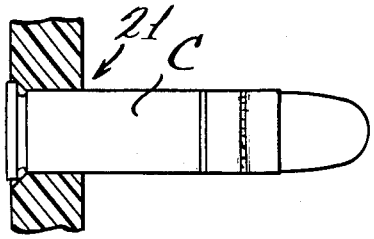
FIG. 5 is a fragmentary view taken generally along line 5—5 of FIG. 2 illustrating one of the apertures in the speed loader with a cartridge seated in the aperture.
Figure 6:
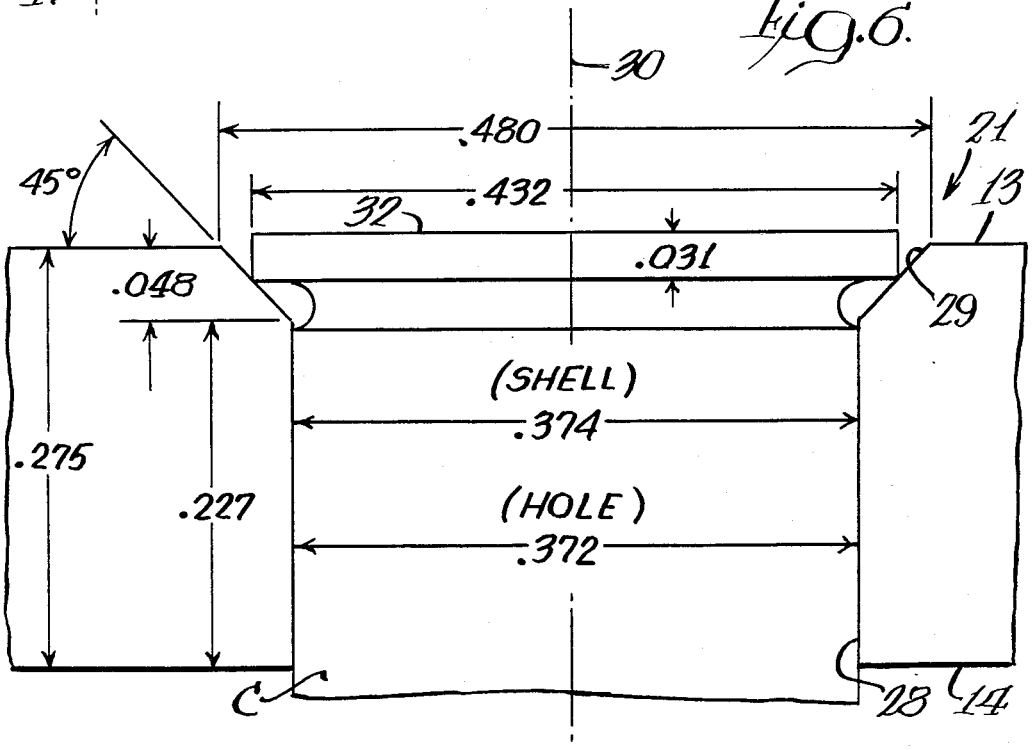
FIG. 6 is an enlarged fragmentary view similar to FIG. 5 describing the dimensional relationships between the cartridge and the guide portion and the rim engaging portion of an exemplary aperture.

Each of the apertures, and with continued reference to the example of aperture 21 in FIGS. 5 and 6, has a rim guiding and release portion 29 that is a frusto-conical surface connecting cylindrical guide portion 28 and rear wall 13. The frusto-conical surface 29 in FIG. 6 has a 45 degree taper angle, which is preferable but the taper may vary to 40 degrees with respect to the centerline 30 of the aperture 21 and operate satisfactorily. An important characteristic of the configuration of the surface portion 29 is that it has an outer diameter greater than the outer diameter of cartridge rim 32. This enables the lower or forward edge of the cartridge rim 32 to seat below rear wall 13 so that during release of the cartridge and rim the lower surface of the rim slides smoothly down the surface 29 without any tendency to hang in the aperture. For the .38 special revolver loader illustrated in the drawings, the major diameter of the rim guide surface 29 is 0.480 inches and its minor diameter is 0.372 inches with an axial length of 0.048 inches. Since the diameter of the rim is about 0.432 inches, the major diameter of the rim guide portion 29 is 0.048 inches greater than the diameter of the rim.

Figure 4:
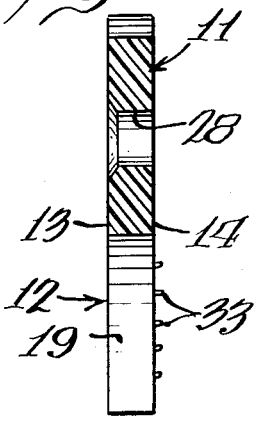
FIG. 4 is a partly fragmentary side view of the speed loader illustrated in FIG. 1.

The handle projection 12 has a plurality of dimple projections 33 on front wall 14 as seen in FIGS. 3 and 4 to provide for improved gripping of the projection 12 during manipulation of the present speed loader.

Figure 7:
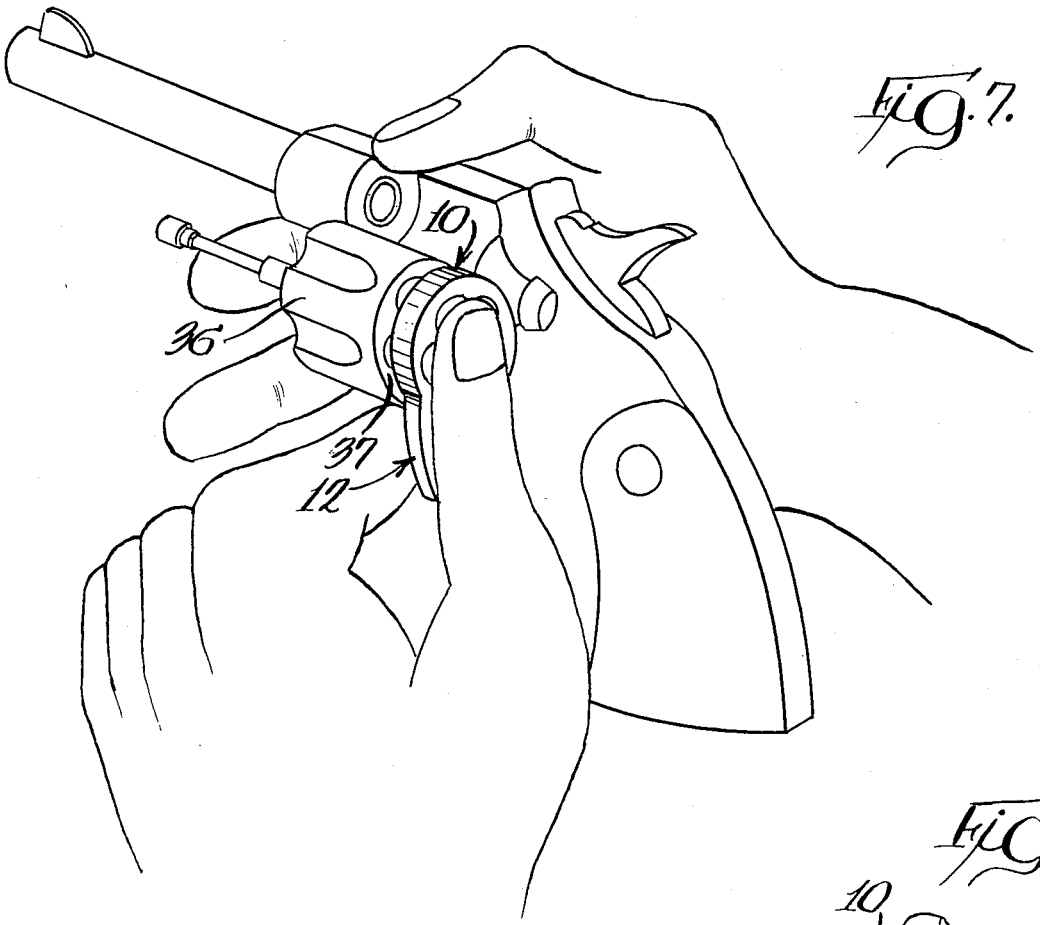
FIG. 7 is a perspective view of the hands of a shooter loading a .38 special pistol with the present speed loader.
Figure 8:
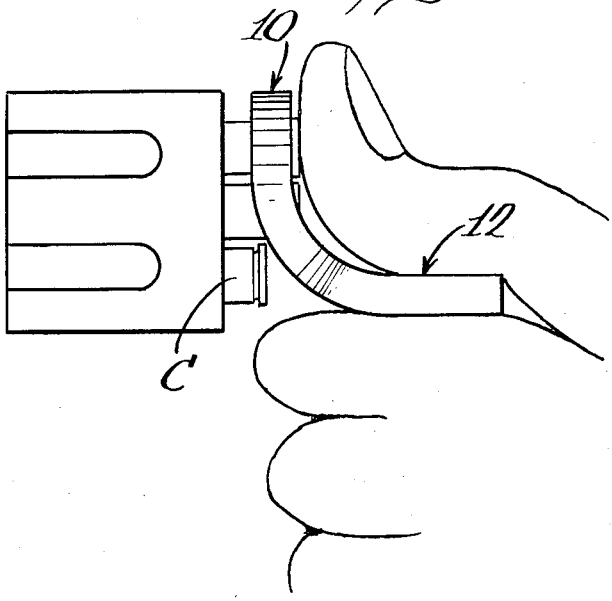
FIG. 8 is a fragmentary side view of the shooter's left hand during the loading process illustrating the peeling of the loader over the cartridge rims.

Reference will now be made to FIGS. 7 and 8 for a discussion of the loading operation of the present speed loader 10. The cartridges C are initially loaded into the speed loader 10 bullet-end first through the rear wall side of the apertures and pushed to their seated positions illustrated in FIGS. 1, 5 and 6. The loading operation shown in FIGS. 7 and 8 is a left-handed loading technique, but the loader 10 works equally well with the right-handed loading technique where the pistol is held upside down in the left hand with the left thumb holding the cylinder barrel.

The shooter in preparation for loading swings out the cylinder to the position shown in FIG. 7, aligns the nose of the bullets with the chambers in the cylinder 36 and releases the holder and cartridges permitting the cartridges to fall into the chambers with the loader attached until the front wall 14 of the loader approaches end wall 37 of the cylinder 36. The user then places his left thumb on rear wall 13 so that it projects somewhat above the top of the loader 10 as shown in FIG. 8, in a generally vertical position with handle projection 12 extending downward in a vertical direction. The shooter then presses with his left thumb grasping the handle 12 between the thumb and the left index finger which is engaged against the rear wall of the handle and bends the handle 12 straight upwardly peeling the loader 10 from the cartridges and their rims, permitting the cartridges to fall to their fully seated positions in the chambers of the pistol cylinder 36.

Figure 9:
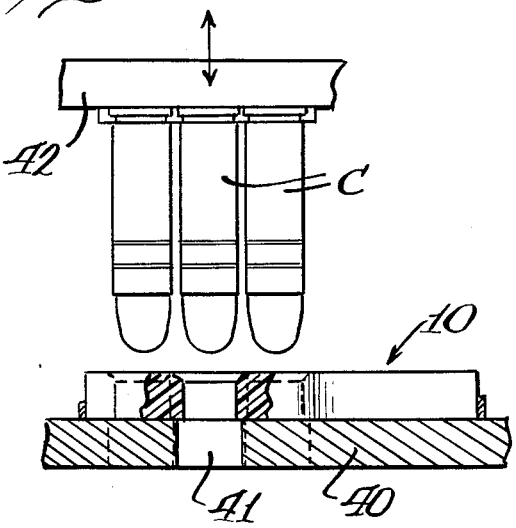
FIG. 9 is a schematic illustration of a mechanism and method for simultaneously loading all of the cartridges into the present loader.

While the speed loader 10 is designed primarily for manual cartridge insertion into the loader by the shooter himself, the loader 10 can be easily mechanically loaded with cartridges by the manufacturer of the cartridges themselves for sale with the loader in a ready-to-load condition. Toward this end and as seen in FIG. 9, the loader 10 is positioned on the upper surface of a platen 40, having apertures 41 therein aligned with apertures 21 to 26 in the speed loader. A vertically reciprocal platen 42 is positioned above platen 40 and has a holding device (not shown) for positioning cartridges C in axial alignment with the apertures 41 in platen 40. The platen 42 is reciprocated downwardly driving the cartridges through the apertures 21 to 26 until they reach their fully seated positions.

Figure 10:
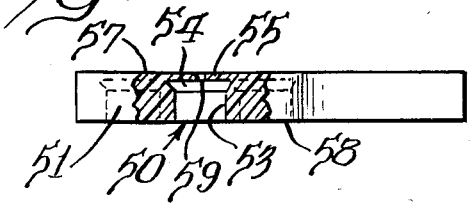
FIG. 10 is a side view of another embodiment of the present speed loader.

In FIG. 10 another embodiment of the present speed loader is illustrated in which the apertures 50 do not extend completely through the circular central body portion 51. Aperture 50 includes an annular guide section 53 and a frusto-conical rim engaging and release portion 54. Aperture 50 is closed at the bottom by a wall 55 integrally formed with body 51 and contiguous with rear surface 57. Wall 55 is sufficiently thin, on the order of 0.025 to 0.050 inches so that it may stretch and not interfere with rim release while at the same time providing increased support for the cartridges. In this embodiment the cartridges are inserted from front surface 58 rather than the rear surface as in the FIGS. 1 to 8 embodiment. A hole 59 is provided in bottom wall 55 to vent the aperture 50 to prevent air entrapment by the cartridge.

A third embodiment of the present speed loader is illustrated in FIGS. 11 to 19 and is seen to be generally similar to the embodiment illustrated in FIG. 10 in that the apertures do not extend completely through the elastomeric body. This speed loader is designated generally by the reference numeral 110 and is seen to include a generally circular body portion 111 that is planar in configuration with a co-planar handle 112 projecting outwardly therefrom. The body portion 111 has six apertures 114 therein all identical in construction. Apertures 114 do not extend all the way through the body portion 111 and have rear walls 116 that are thin on the order of 0.031 inches (see FIG. 15) so that they flex easily during cartridge releasing and hence do not adversely affect the ease of release. Rear walls 116 each have vents 117 therein to prevent the entrapment of air in the recesses both during cartridge insertion and during release.

Figure 11:
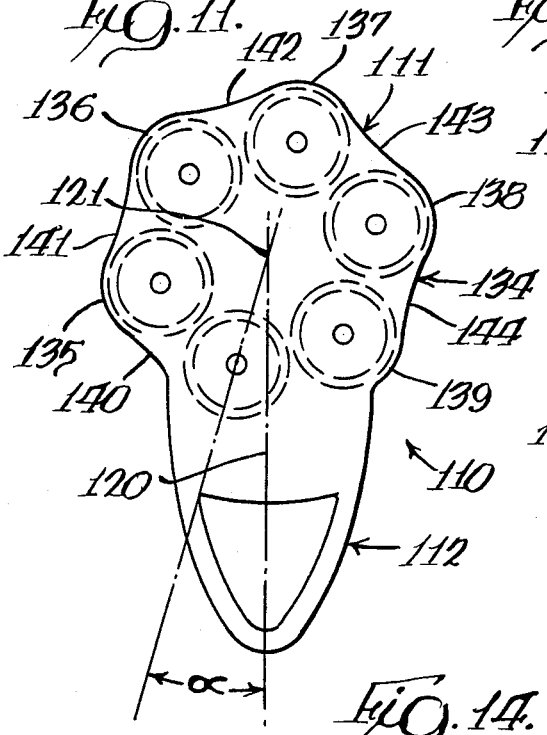
FIG. 11 is a rear view of a third embodiment of the present speed loader.
Figure 12:
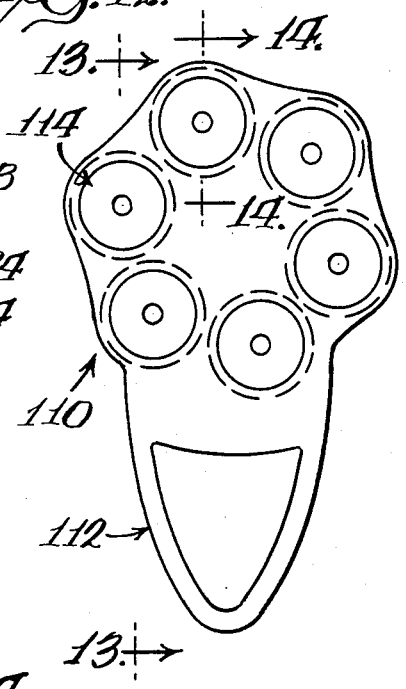
FIG. 12 is a front view of the speed loader illustrated in FIG. 11.
Figure 13:
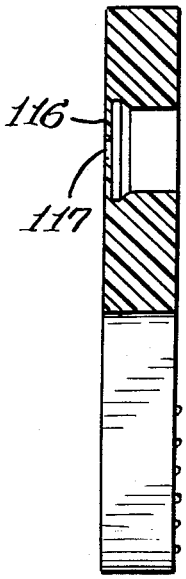
FIG. 13 is partly fragmentary left side view taken generally along line 13—13 of FIG. 12.
Figure 14:
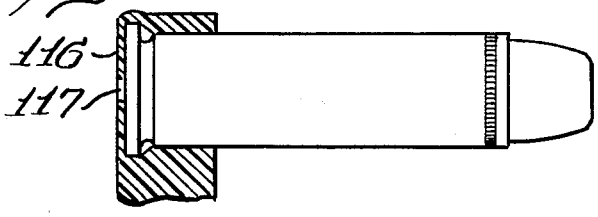
FIG. 14 is an enlarged fragmentary section of one aperture with a cartridge positioned therein taken generally along line 14—14 of FIG. 12.

As seen in FIGS. 11 and 12, the apertures 114 are asymmetrically positioned with respect to a radial line 120 extending from body center 121 centrally through the projecting handle 112, i.e., the axis of symmetry of the apertures is angularly related to radial line 120. The angle of asymmetry between radial line 120 and the axis of the nearest aperture 114 is equal to one quarter of the angular distance between the apertures. In the embodiment of FIGS. 11 and 12 there are six apertures 114 and hence an arcuate distance length of 60 degrees so that the angle $\alpha$ in a six cartridge loader is 15 degrees. This asymmetrical positioning of the apertures 114 with respect to the handle 112 assures that no two cartridges will be released at exactly the same instant providing a smoother and easier cartridge release.

Figure 15:
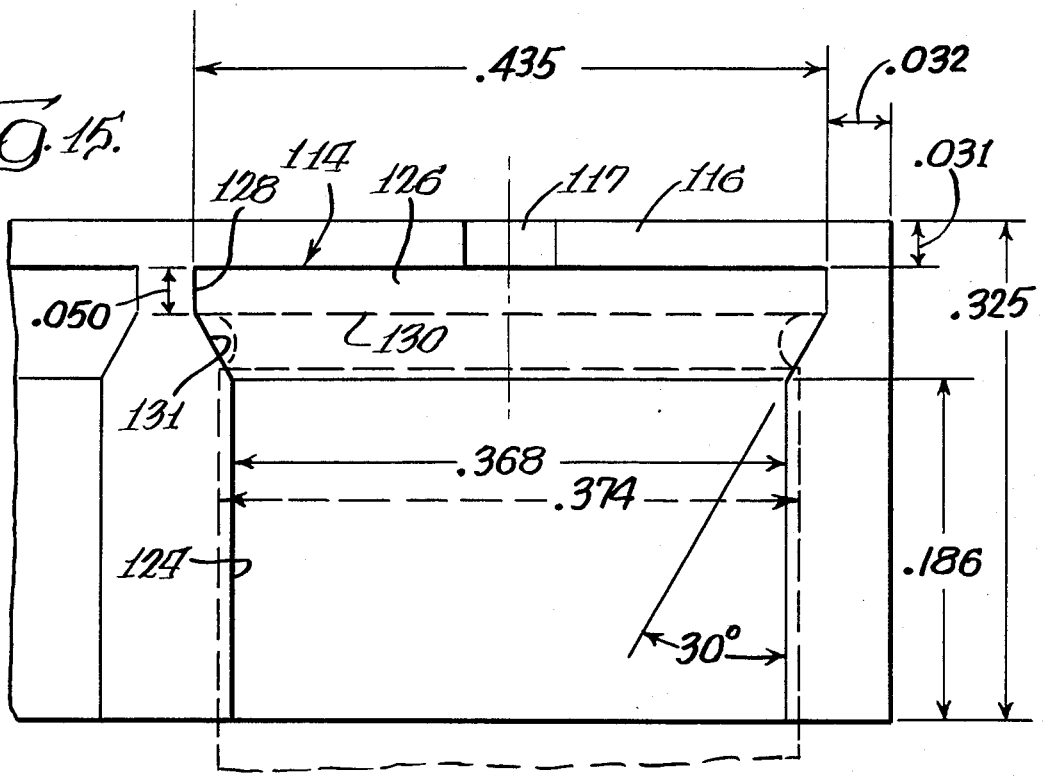
FIG. 15 is a further enlarged fragmentary section of one aperture in the speed loader illustrated in FIGS. 11 to 14 with a cartridge illustrated with dotted lines.

As seen more clearly in FIG. 15, the apertures 114 include a cylindrical cartridge gripping portion 124 with a relaxed diameter of approximately 0.368 inches so that it will stretch slightly to grip the 0.374 cartridge diameter in .38 and .357 cartridges. The cartridge is illustrated in dotted lines in FIG. 15.

Cartridge rim 126 is seated within an enlarged straight cylindrical recess 128 having a diameter slightly greater than the rim 126 so that it does not grip the rim at all diametrically and hence does not interfere with the release of the rim from the aperture. Recess 128 has an axial length approximating the thickness of the rim 126, i.e., approximately 0.050 inches.

As in the FIGS. 1 to 9 embodiment, rim lower surface 130 seats against a frusto-conical surface 131 preferably forming an angle of 30 degrees with respect to the centerline of the apertures 114. Surface 131 permits the easy release of rim 126 from recess 128.

As seen in FIGS. 11 and 12, the peripheral surface 134 of the body portion 111 is formed by a plurality of arcuate convex lobes 135, 136, 137, 138 and 139 joined by arcuate concave recesses 140, 141, 142, 143 and 144.

The arcuate surfaces 135–139 are defined by a radius 0.032 larger than the radius of recess 128 about the axis of apertures 114. This results in a minimum outer wall thickness between the rim 126 and outer wall 134 of 0.032 inches. It is in part this thin outer wall that permits the present loader 110 to pass by most of the available grips during the loading process.

The concave recesses 140 to 144 between the lobes 135 to 139 further assist in permitting the speed loader to pass by even larger pistol grips. The arcuate recesses 140 to 144 have centers lying on radial lines bisecting apertures 114 with a radius of approximately 1.5 inches tangent to the curves of the adjacent lobes 135 to 139.

Figure 16:
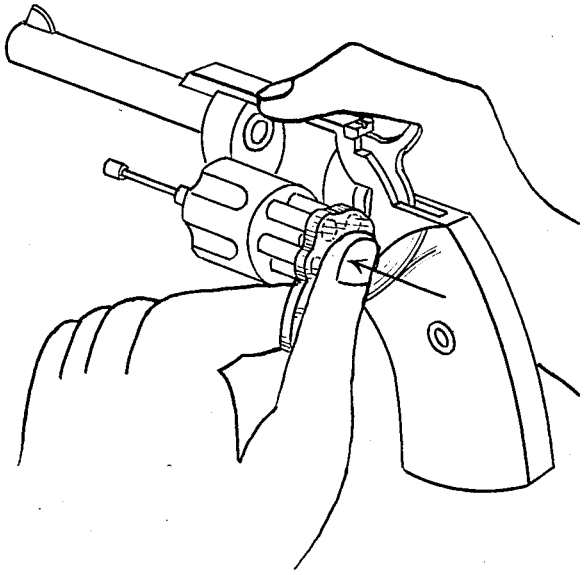
FIGS. 16 to 19 are views illustrating the manner of insertion of the cartridges into a revolver with the speed loader of FIGS. 11 to 15.
Figure 18:
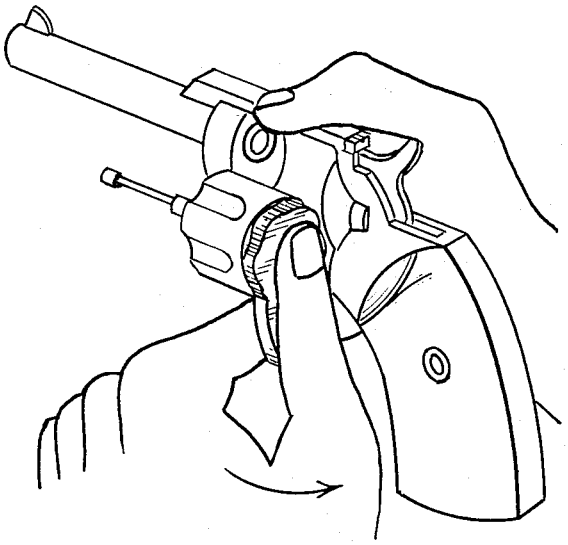
Figure 17:
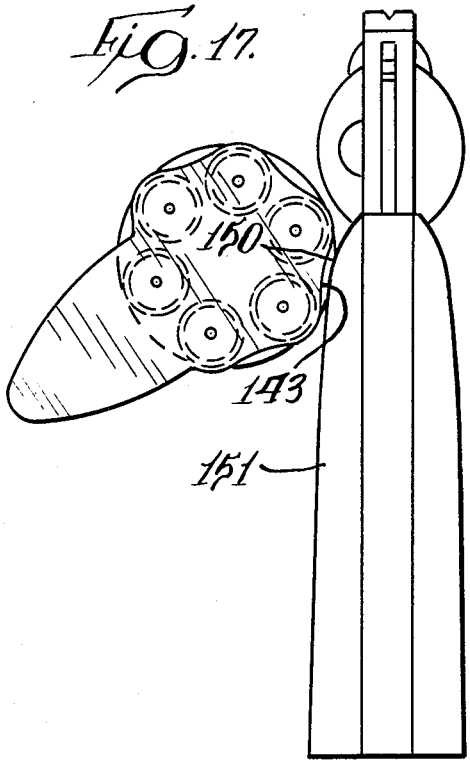
Figure 19:
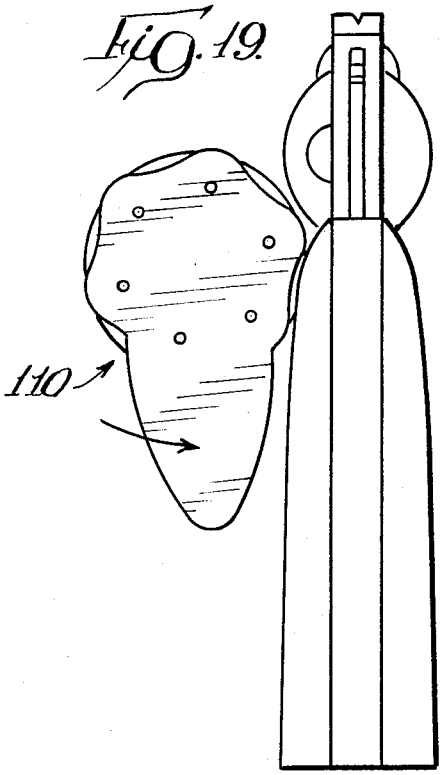

During cartridge loading, as seen in FIGS. 16 to 17, when loading a revolver with large normally interfering grips, the noses of the bullets are inserted into the cylinder chambers with the speed loader angularly positioned as seen in FIG. 17 with one of the recesses, in this case recess 143, directly facing the protruding portion 150 of pistol grip 151. This permits the speed loader and the cartridges to slide axially without engaging any portion of the grip 151. After clearing the grip 151, the speed loader 110 may be rotated to any desired angular position for the roll release described above in connection with FIGS. 1 to 9 embodiment. Of course, any one of the other recesses 140, 141, 142 or 144 may be positioned to face protruding grip portion 150 depending upon the particular loading technique that the user finds comfortable.

I claim:

1. A speed loader for loading cartridges into a revolver having annularly arrayed chambers in a cylinder, comprising; a generally planar one-piece flexible body member, having an outer and an inner surface spaced therefrom, constructed of a flexible elastomeric material, said member having a central generally circular portion with a plurality of annularly arrayed apertures therein extending substantially completely therethrough, each adapted to receive one cartridge, each of said apertures having a cylindrical guide portion engagable with the cartridge of sufficient length to hold the cartridge substantially perpendicular to the planar body member, each of said apertures having a rim engaging portion discontinuous with the outer surface of the planar body member to facilitate the release of the rim and the cartridge from the aperture, and an integral projection extending from the central portion, said planar body member having sufficient resiliency so that the cartridges loaded in the body member may be simultaneously loaded in the revolver chambers with the shooter's thumb placed on the outer surface of the body member and one of his fingers placed under the projection raising the body member over the rims of all the cartridges substantially simultaneously to release the cartridges in the revolver chambers.

2. A speed loader as defined in claim 1, wherein the body member is constructed of an elastomeric material having a hardness durometer between 40 and 70.

3. A speed loader as defined in claim 1, wherein the body member is constructed of an elastomeric material having a hardness durometer of approximately 55 to 62.

4. A speed loader as defined in claim 1, wherein each of the rim engaging portions is frusto-conical in configuration.

5. A speed loader as defined in claim 1, wherein the elastomeric body member is constructed of polyurethane having a hardness durometer in the range of 40 to 70.

6. A speed loader as defined in claim 1, wherein the elastomeric body member is constructed of silicone rubber.

7. A speed loader as defined in claim 1, wherein said projection extends along a radius from the center of the central section, said apertures being arrayed with respect to the radius so that no two of the apertures lie on a line perpendicular to the radius to facilitate release of the rims and cartridges from the body member as the projection is lifted away from the cartridges.

8. A speed loader for loading cartridges into a revolver having annularly arrayed chambers in a cylinder, comprising; a one-piece elastomeric body member having a hardenss of 40 to 70 durometer, said body member having a generally circular portion with annularly arrayed apertures therein for receiving and holding the cartridges, each of said apertures having an uninterrupted annular guide portion for holding the cartridges substantially perpendicular to the body member and a rim engaging quick release portion that engages a forward portion of the rim, and an integral projection on the body member extending generaly radially therefrom so that the user may grasp and roll the body member over the rims of the cartridges permitting them to pass through the apertures and be released in the chambers of the revolver.

9. A speed loader as defined in claim 8, wherein the body member is polyurethane.

10. A speed loader as defined in claim 8, wherein the body member is silicone rubber.

11. A speed loader as defined in claim 8, wherein each of the apertures has a frusto-conical portion engagable with the cartridge rim to facilitate release of the cartridges into the apertures.

12. A speed loader as defined in claim 8, wherein said projection extends along a radius from the center of the central section, said apertures being arrayed with respect to the radius so that no two of the apertures lie on the same line perpendicular to the radius to facilitate release of the rims and cartridges from the body member as the projection is lifted away from the cartridges.

13. A speed loader for a revolver having a cylinder with annularly arrayed chambers therein, comprising; a one-piece elastomeric planar body member, said elastomeric body member having a hardness in the range of 40 to 70 durometer, said body member having a central generally circular portion with a plurality of annularly arrayed apertures therein extending substantially completely therethrough, each of said apertures having a cylindrical portion of sufficient length to hold a cartridge therein perpendicular to the planar body member, each of said apertures also having a frusto-conical portion at one end thereof engagable with the rim of the cartridge therein to facilitate the release of the cartridges through the apertures, and an integral projection extending radially from the central circular portion adapted to be grasped by the user, after the cartridges positioned in the loader have been inserted in the chambers, and roller over the cirular portion rolling that portion away from the rims of the cartridges and releasing the cartridges from the apertures into the chambers.

14. A speed loadèr for a revolver having a cylinder with annular arrayed chambers therein, comprising; a one-piece elastomeric, planar body member, said elastomeric body member having a hardness in the range of 40 to 70 durometer, said body member having a central generally circular portion with a plurality of annularly arrayed apertures therein extending substantially completely therethrough, each of said apertures having a cylindrical portion of sufficient length to hold a cartridge therein perpendicular to the planar body member, each of said apertures also having a frusto-conical portion at one end thereof engagable with the rim of the cartridge therein to facilitate the release of the cartridges through the apertures, an integral projection extending radially from the central circular portion adapted to be grasped by the user, after the cartridges positioned in the loader have been inserted in the chambers, and rolled over the circular portion rolling that portion away from the rims of the cartridges and releasing the cartridges from the apertures into the chambers, said projection extending along a radius from the center of the central section, and said apertures being arrayed with respect to the radius so that no two of the apertures lie on a line perpendicular to the radius to facilitate release of the rims and cartridges from the body member as the projection is lifted away from the cartridges.

15. A speed loader for a revolver having annularly arrayed chambers therein for receiving ammunition cartridges, comprising; a one-piece elastomeric body member, said body member having a plurality of annularly arrayed apertures therein, each of said apertures being configured to hold a cartridge perpendicular to the body member, each of said apertures having a resilient frusto-conical rim engaging portion for engaging the forward portion of the rim to facilitate the release of the rim therefrom, and a projection extending generally outwardly from the body member adapted to be pushed or pulled by the user, after the cartridges previously inserted into the apertures have been simultaneously inserted into the revolver chambers, rolling the body member away from the rims substantially simultaneously releasing the cartridges from the apertures into the revolver chambers.

16. A speed loader for loading cartridges into a revolver having annularly arrayed chambers in a cylinder, comprising; a one-piece elastomeric body member having a hardness of 50 to 80 Shore A durometer, said body member having a generally circular portion with annularly arrayed apertures therein for receiving and holding the cartridges, said apertures extending alsmost completely through the body defining a thin flexible rear wall at the end of each aperture, a vent hole in each of the aperture rear walls for permitting air to enter the aperture during removal of the loader from the cartridge prior to firing, each of said apertures having an annular guide portion for holding the cartridges substantially perpendicular to the body member, and an integral projection on the body member extending generally radially therefrom so that the user may grasp and roll the body member over the rims of the cartridges permitting them to pass though the apertures and be released in the chambers of the revolver.

17. A speed loader for loading cartridges into a revolver having annularly arrayed chambers in a cylinder, comprising; a one-piece elastomeric body member having a Short A hardness of 50 to 80 durometer, said body member having a generally circular portion with annularly arrayed apertures therein for receiving and holding the cartridges, said body member having curved recesses between the apertures along its outer periphery so the body may pass freely by revolver grips and other protruding revolver parts, each of said apertures having an annular guide portion for holding the cartridges substantially perpendicular to the body member, and an integral projection on the body member extending generally radially therefrom so that the user may grasp and roll the body member over the rims of the cartridges permitting them to pass through the apertures and be released in the chambers of the revolver.

* * * * *